United States Patent [19]

Tiitola

[11] Patent Number: 4,757,620

[45] Date of Patent: Jul. 19, 1988

[54] SOLE STRUCTURE FOR A SHOE

[75] Inventor: Antti-Jussi Tiitola, Kaivanto, Finland

[73] Assignee: Karhu-Titan Oy, Finland

[21] Appl. No.: 125,255

[22] Filed: Nov. 25, 1987

Related U.S. Application Data

[63] Continuation of Ser. No. 897,515, Aug. 18, 1986, abandoned.

[30] Foreign Application Priority Data

Sep. 10, 1985 [FI] Finland ..... 853461

[51] Int. Cl.[4] ..... A43B 13/12; A43B 13/18

[52] U.S. Cl. ..... 36/28; 36/30 R; 36/31

[58] Field of Search ..... 36/30 R, 31, 30 A, 28, 36/25 R, 103, 32 R, 114

[56] References Cited

U.S. PATENT DOCUMENTS

| | | | |
|---|---|---|---|
| 4,030,213 | 6/1977 | Daswick | 36/103 |
| 4,224,747 | 9/1980 | Winfield | 36/30 R |
| 4,241,523 | 12/1980 | Daswick | 36/30 R |
| 4,348,821 | 9/1982 | Daswick | 36/30 R |
| 4,372,059 | 2/1983 | Ambrose | 36/30 R |

FOREIGN PATENT DOCUMENTS

| | | | |
|---|---|---|---|
| 0023356 | 2/1981 | European Pat. Off. | 36/31 |
| 0142677 | 5/1985 | European Pat. Off. | 36/30 R |
| 911190 | 6/1946 | France | 36/31 |

OTHER PUBLICATIONS

WO8304166, 12/1983, PCT, Schmohl.

*Primary Examiner*—Steven N. Meyers

[57] ABSTRACT

A sole structure of a shoe, e.g. a sport shoe, comprising an outer wearing sole, an inner or intermediate layer, and additionally a cushioning and supporting structure between the sole and layer. The cushioning and supporting structure has a flexible toe portion extending substantially from a tip of the shoe to a ball area of a foot in the shoe, a resilient heel portion tapering in a wedge-like manner from a rear edge of the shoe towards the forward tip of the shoe, and extending at least over a heel area of the shoe, and additionally a body piece fitted above the heel portion and substantially extending from the rear edge of the shoe to the ball area of the foot, over a zone adapted to fit against the heel of the arch of the foot. The body piece is substantially stiffer and harder than the heel portion and the toe portion. The body portion is preferably fixed to the inner or intermediate layer along the entire length of the upper surface of the body portion, or at the location fitting against the heel and the arch of the foot. The body portion is also preferably fixed to the heel portion and to the toe portion along a lower surface of the body portion, or along principally downwardly extending surfaces of the body portion.

19 Claims, 3 Drawing Sheets

SOLE STRUCTURE FOR A SHOE

This is a continuation of application Ser. No. 897,515, filed 8/18/86, now abandoned.

BACKGROUND OF THE INVENTION

The present invention is directed to a sole structure in a shoe, e.g., a sports shoe, the sole structure comprising an outer, wearing sole, an inner or intermediate layer for contact with a foot within the shoe, and a cushioning and supporting structure between the sole and the layer.

Running shoes, especially for marathon and other long-distance running races, have two basic requirements. The principal task of the shoe is to help the act of running, so that the runner moves forwardly as sparingly as possible. The other task of the shoe is to protect the feet for running exertion, so that conditions for the runner's optimum performance may also be preserved or maintained through the latter part of a running race. To achieve the aforementioned functions, many different shoes have been developed with resilient sole structure to reduce the exertion directed to the runner's feet.

Resilience of the sole can be obtained in many different ways. For example, an air cushion structure can be used or the sole can be constructed of several layers, one upon the other, the hardness and density of which vary to achieve progressive flexibility. However, a disadvantage in the previously-known shoes is that during the act of running, when the shoe is placed against the running ground, marked and unnecessary deformations take place in the shoe sole, so that the shoe sole returns to its original form only when the shoe is in the air. The runner wastes in this fashion a great deal of energy only for the deformation of the shoe sole.

SUMMARY OF THE INVENTION

Accordingly, it is an object of the present invention to improve running.

It is also an object of the present invention to minimize energy expenditure/waste during running.

It is another object of the present invention to provide an entirely new sole structure for a shoe e.g., a sports shoe, by which the aforementioned disadvantages noted with respect to previously-used shoes are eliminated.

It is a further object of the present invention to eliminate unnecessary deformation in a running shoe.

These and other objects are attained by the present invention, which is directed to a sole structure for a shoe comprising an outer sole, an inner or intermediate layer, and a cushioning and supporting structure situated therebetween, said outer sole having a wearing surface with a configuration such that during a rolling phase of use, said wearing surface is substantially entirely in contact with ground underneath said cushioning and supporting structure. The cushioning and supporting structure comprises both a flexible toe portion substantially extending from a forward tip of the shoe to an area thereof corresponding to the area which receives a ball of a foot, and a resilient heel portion, tapering in a wedge-like manner from a rear edge of the shoe towards the front tip thereof, and extending over at least an area of the shoe for receiving a heel of the foot. Additionally, the cushioning and supporting structure comprises a body portion situated above the heel portion and substantially extending from the rear edge of the shoe to the area for receiving the ball of the foot, over a zone adapted to fit or abut against the heel and an arch of the foot. The body portion is substantially stiffer and harder than both the heel portion and the toe portion of the cushioning and supporting structure.

Thus, in order to achieve these and other objects described below, the present invention is principally characterized by the cushioning and supporting structure having a resilient toe portion substantially extending to the ball area of the foot (i.e. the area of the shoe for receiving the ball of the foot), and a flexible heel portion tapering in a wedge-like manner from the rear edge of the shoe towards the front tip of the shoe, and extending at least over the heel area thereof (i.e. the area of the shoe for receiving the heel of the foot). Additionally, a body piece or portion is fitted above the heel portion and substantially extends from the rear edge of the shoe to the ball area of the foot, over the zone adapted to fit or abut against the heel and arch of the foot. This body piece is substantially stiffer and harder than the heel portion and the toe portion.

The following advantages, in addition to others, may be noted among the advantages of the present invention over the previously-known structures. The sole structure according to the present invention efficiently receives the impact directed to the runner's heel in a landing phase of the foot during the step of running. In a so-called rolling phase of the foot during the running step, the sole structure of the present invention effectively supports the arch of the foot, on account of which the exertions directed to the foot are lighter. In a take-off phase of the foot during the running step, unnecessary sliding of the shoe can very effectively be eliminated by the sole structure according to the present invention.

BRIEF DESCRIPTION OF THE DRAWINGS

The present invention will now be described in greater detail with reference to the figures of the accompanying drawings, which illustrate an exemplary adaptation of the present invention, without limiting the scope thereof. In the drawings.

DESCRIPTION OF THE PREFERRED EMBODIMENT

Figure 1:
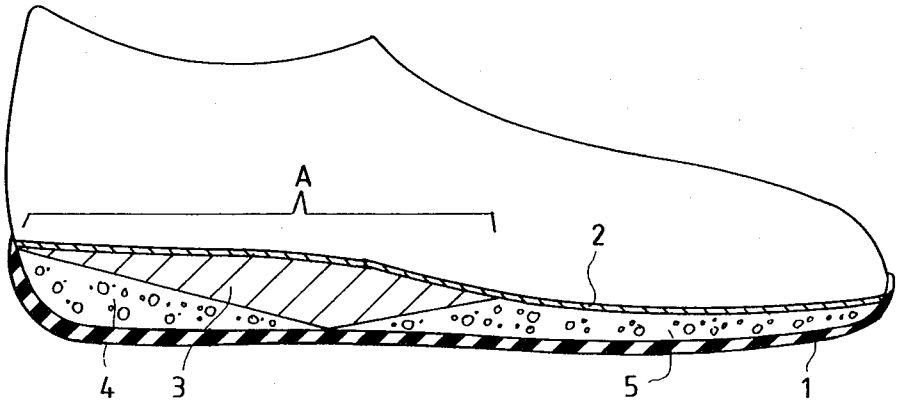
FIG. 1 illustrates a schematic longitudinal sectional view of a sole structure according to the present invention.

A sole structure of a sports shoe according to the present invention illustrated in FIG. 1, comprises an outer or wearing sole 1, an inner or intermediate layer 2, and additionally a cushioning and supporting structure between the sole 1 and layer 2. This cushioning and supporting structure comprises a body piece or portion 3, a heel portion 4, and a toe portion 5. The body portion 3 is composed of rigid and strong material and is fitted to the area A in the sole structure of the shoe for fitting or abutting against the heel and the arch of a foot. The body piece or portion 3 thus extends from the rear part of the shoe substantially to the ball of the foot (i.e. the area of the shoe for receiving the ball of the foot).

The body piece or portion 3 is composed of such rigid material, that the shoe is virtually inflexible in the area of the body piece 3. During running, the body piece 3 maintains its form supporting the arch, so that exertions directed to the foot remain lighter. The body piece is formed in such a way, that the height of its longitudinal section increases from the rear edge of the shoe towards the front part of the shoe in a suitable fashion, principally linearly, with the sectional height being the greatest at or in front of a front edge of the heel portion 4 of the shoe.

The heel portion 4 remaining between the body piece or portion 3 and the wearing sole 1, is therefore wedge-like in shape, so that the height of the heel portion 4 in its longitudinal section is greatest in the area of the rear part of the heel. Necessary resiliency and shock absorption ability is thus achieved with the heel portion 4 in a landing phse of the foot during running. Therefore, the heel portion 4 is composed of a flexible, preferably light and foamy material. Any material with sufficient flexibility and shock absorption ability can naturally be used in the heel portion 4. Thus, for example, an air cushion structure, layer structure, or equivalent can be used in the heel portion 4.

It is stated above that the longitudinal sectional height or thickness of the body piece or portion 3 increases linearly from the rear edge of the shoe towards the front part thereof. However, this change in thickness need not necessarily be linear. Rather, the junction point of the body piece 3 and the heel part 4 may also be curved.

Figure 3A:
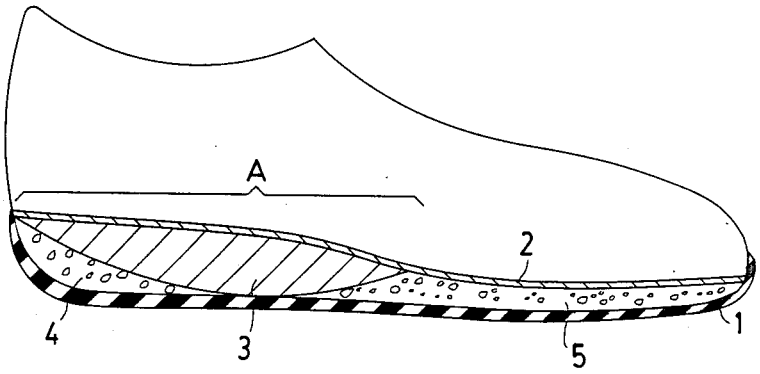
FIGS. 3A and 3B are views, similar to FIG. 1, of alternative embodiments of the present invention.
Figure 3B:
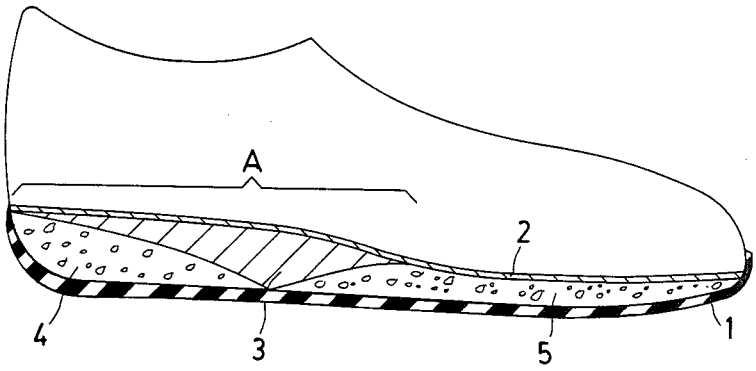

The surface of the body piece 3 fitted against the heel portion 4 can then also be downwardly convex, while the upper surface of the heel portion 4 can be correspondingly upwardly concave (FIG. 3A). Alternatively, this surface of the body piece 3 can also be downwardly concave, in which case the upper surface of the heel portion 4 is correspondingly convex (FIG. 3B). Radii of curvature of the surfaces are in any event great, so that the thickness variations of the body piece 3 and of the heel portion 4 are almost linear.

The toe portion 5 between the outer wearing sole 1 and the inner or intermediate layer 2 in front of the body piece 3, can advantageously be made of the same resilient material as the heel portion 4. The toe portion 5 extends from the front tip of the shoe to the ball area of the foot, or to a zone of take-off power during running. Due to the noted toe portion 5 being flexible, better grip or greater frictional force is achieved between the wearing sole 1 and the running ground. Thus, unnecessary sliding is avoided in the take-off phase, so that the runner may move forwardly more rapidly. To obtain suitable flexibility, the toe portion 5 can also be composed of several different materials, as can the heel portion 4.

As illustrated in FIG. 1, the body piece 3 also tapers in a wedge-like fashion at the front part thereof. This is not, however, necessary for practicing the present invention, but is advantageous, because it is easier to control the bending point of the shoe with this form of the front end of the body piece 3. If the front part of the body piece 3 is also wedge-shaped, then the noted wedge-shapeness can be accomplished in the same manner as in the rear part of the body piece 3. The surface of the body piece 3 fitting against the toe portion 5 may both be linear or curved (FIGS. 3A and 3B).

However, the wedge-like tapering of the body piece 3 towards the rear part of the shoe, according to FIG. 1, is more important than the form of the front part in the shape of the body piece 3. With this arrangement, the wedge-shaped form of the heel portion 4 is achieved as illustrated in FIG. 1. Due to this shape, the shock absorption ability of the shoe is greatest just at the rear part of the shoe. FIG. 1 also illustrates that the body piece 3 extends at is thickest zone, from the intermediate or inner layer 2 to the outer wearing sole 1. Moreover, the body piece 3 must naturally be fixed to the intermediate layer 2 over its entire length, in order to support the arch of the foot as best as possible.

It is also described above, that the body piece 3 is formed of substantially rigid material, while the heel portion 4 and the toe portion 5 are formed of substantially flexible material. However, the most important consideration in this respect, is that the stiffness of the body piece 3 is substantially greater than the stiffness of the noted heel portion 4 and the toe portion 5. In performed tests, the necessary stiffnesses and resiliencies have been obtained with materials by which the hardness of the body piece 3 is about 50 Shore A, and correspondingly 35 Shore A for the heel portion 4 and the toe portion 5.

Figure 2C:
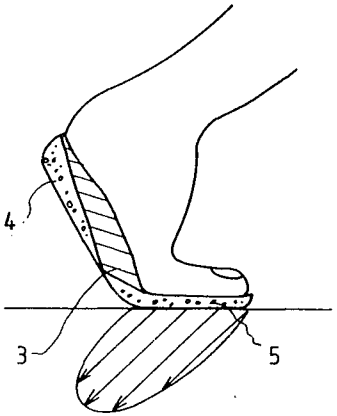
FIGS. 2A, 2B, and 2C are schematic illustrations of the functioning of a sole structure in accordance with the present invention, in different phases of a running sequence.
Figure 2B:
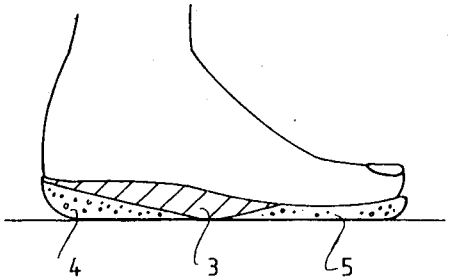
Figure 2A:
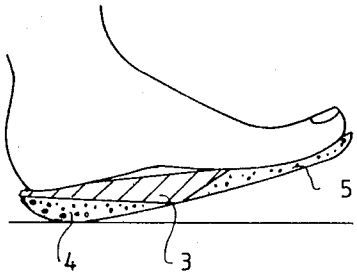

Reference is made to FIGS. 2A, 2B, and 2C in the following, where the functioning of the sole structure according to the present invention is described in different phases of a running step or sequence. In FIG. 2A, the landing or impact phase of the foot is presented. Long-distance runners such as marathon runners and the like, especially being their running step so that either the middle part of the sole or backwardly therefrom, is the first part to hit the ground. Only very few long-distance runners make their steps with the balls of the feet.

The farther the landing point is, the less the flexibility needed in the shoe to absorb the impact forces, and the greater the part of the impact received by the runner's own muscles. Therefore, the heel portion 4 of the sole structure according to the present invention, is formed as a wedge increasingly thicker backwardly. Thus, the more rear the first impact point is, the greater is the cushioning ability of the sole structure.

FIG. 2B illustrates the rolling phase of the foot during running. In this phase, the runner's center of gravity is downwardly stopped, and the foot prepares to take-off upwardly and forwardly. The greatest pressure is, in this case, directed to the arch zone. The sole structure of the shoe must not become too flat because of this, so that the runner would not lose energy to the deformations of the sole structure. The shape of the body piece 3 according to the invention, has an important effect in the function of the rolling phase helping to begin the take-off phase. Because the rigid body piece 3 extends, at its thickest zone, from the intermediate layer 2 to the wearing sole 1, the shoe does not therefore become flat, but rather the foot may more easily and quickly turn to the take-off phase.

FIG. 2C illustrates the take-off phase of the foot during running. In this phase, the flexible energy stored in the muscles and the thrust of the foot are transferred through the shoe to the running ground. In this phase, it is important that as great friction force as possible is formed between the shoe and the ground, so that the take-off moves the runner forwardly. In the sole structure according to the present invention, this is influenced by the flexible material of the toe portion 5 under the toe zone and the ball of the foot, the thickness of the sole structure in the area of the toe portion 5, as well as the quality of the wearing sole 1.

Physically, it is important that during the entire take-off phase, the contact surface between the shoe and the ground is as large as possible. In practice, the frictional force increases proportionately to the contact area. Therefore, the wearing sole 1 in the sole structure according to the present invention, is smooth and unperforated over the range of influence of the take-off force or under the toe portion 5. Performed tests have shown that, with the sole structure according to the invention or with the unperforated wearing sole 1 and resilient toe portion 5, remarkably better direction and magnitude of the take-off force are achieved in the take-off phase than with conventional structures.

The invention has been described above with respect to an example referring to the figures of the drawings. This does not, however, limit the scope of the present invention in any way. Many changes are possible within the scope and the principles of the present invention, as set forth above.

What is claimed is:

1. A sole structure for a shoe, comprising an inner layer, and a cushioning and supporting structure situated underneath said inner layer, said cushioning and supporting structure comprising an outer sole having a wearing surface with a configuration such that during a rolling phase of use, said wearing surface is substantially entirely in contact with ground underneath said cushioning and supporting structure, a flexible toe portion substantially extending from a forward-tip of the shoe to an area thereof corresponding to the area which receives a ball of a foot, a resilient heel portion, tapering in a wedge-like manner from a rear edge of the shoe towards the forward tip of the shoe and extending over at least an area of the shoe for receiving a heel of the foot, and a body portion situated above said heel portion and substantially extending from the rear edge of the shoe to the area for receiving the ball of the foot over a zone adapted to fit against the heel and an arch of the foot, said body portion being substantially stiffer and harder than said heel portion and said toe portion, wherein said wearing surface of said outer sole is substantially flat.

2. The sole structure of claim 1, wherein said body portion is fixed to said inner layer over an upper surface thereof along one of an entire length of said body portion and the zone for fitting against the heel and arch of the foot, and said body portion is fixed to said heel portion and to said toe portion over one of a lower surface of said body portion and substantially downwardly extending surfaces of said body portion.

3. The sole structure of claim 1, wherein surfaces of said body portion and of said heel portion abutting against one another are substantially flat.

4. The sole structure of claim 1, wherein surfaces of said body portion and of said heel portion abutting against one another are substantially curved.

5. The sole structure of claim 1, wherein said body portion tapes in a wedge-like manner from a front edge of said heel portion to the area for receiving the ball of the foot.

6. The sole structure of claim 5, wherein surfaces of said body portion and of said toe portion abutting against one another are substantially flat.

7. The sole structure of claim 5, wherein surfaces of said body portion and of said toe portion abutting against one another are substantially curved.

8. The sole structure of claim 1, wherein the hardness of said body portion is about 50 Shore A and the hardness of said heel portion and of said toe portion is about 35 Shore A.

9. The sole structure of claim 1, wherein said body portion has a height increasing over a longitudinal section thereof from the rear edge of the shoe towards the front tip thereof.

10. The sole structure of claim 9, wherein said body portion logitudinal height increases substantially linearly.

11. The sole structure of claim 9, wherein said height of said body portion is greatest at or immediately forward of a front edge of said heel portion.

12. The sole structure of claim 4, wherein said surface of said body portion is downwardly convex and said surface of said heel portion is upwardly concave.

13. The sole structure of claim 4, wherein said surface of said body portion is downwardly concave and said surface of said heel portion is upwardly convex.

14. The sole structure of claim 1, wherein said heel portion and said toe portion are constructed of the same resilient material.

15. The sole structure of claim 1, wherein said outer sole is substantially smooth and unperforated.

16. The sole structure of claim 1, wherein lower surfaces of said body portion abutting said heel and toe portions come to a point adjacent said outer sole, when viewed in a cross-section along the longitudinal axis of the shoe.

17. The sole structure of claim 1, wherein said body portion, at a thickest zone thereof, extends from said inner layer to said outer sole.

18. A sole structure for a shoe, comprising an inner layer and a cushioning and supporting structure situated underneath said inner layer, said cushioning and supporting structure comprising an outer sole having a wearing surface with a configuration such that during a rolling phase of use, said wearing surface is substantially entirely in contact with ground underneath said cushioning and supporting structure, a flexible toe portion substantially extending from a forward tip of the shoe to an area thereof corresponding to the area which receives a ball of a foot, a resilient heel portion, tapering in a wedge-like manner from a rear edge of the shoe towards the forward tip of the shoe and extending over at least an area of the shoe for receiving a heel of the foot, and a body portion situated above said heel portion and substantially extending from the rear edge of the shoe to the area for receiving the ball of the foot over a zone adapted to fit against the heel and an arch of the foot, said body portion being substantially stiffer and harder than said heel portion and said toe portion, wherein an inner surface of said outer sole opposite said wearing surface is substantially flat.

19. A sole structure for a shoe, comprising an inner layer, and a cushioning and supporting structure situated underneath said inner layer, said cushioning and supporting structure comprising an outer sole having a waring surface, a flexible toe portion substantially extending from a forward tip of the shoe to an area thereof corresponding to the area which receives a ball of a foot, a resilient heel portion, tapering in a wedge-like manner from a rear edge of the shoe towards the forward tip of the shoe and extending over at least an area of the shoe for receiving a heel of the foot, and a body portion situated above said heel portion and substantially extending from the rear edge of the shoe to the area for receiving the ball of the foot over a zone adapted to fit against the heel and an arch of the foot, said body portion being substantially stiffer and harder than said heel portion and said toe portion, wherein said wearing surface of said shoe is substantially flat, whereby, during running, said cushioning and supporting structure effectively receives impact during a landing phase, during a rolling phase, said wearing surface of said outer sole is substantially entirely in contact with ground underneath said cushioning and supporting structure which effectively supports the arch of the foot in the shoe so that the foot may easily and quickly turn to a take-off phase, and in the take-off phase, contact between the wearing surface and the ground is as great as possible, so that better direction and magnitude of take-off force are achieved and unnecessary sliding of the shoe is eliminated.

* * * * *